United States Patent [19]

Mentler

[11] 3,988,649

[45] Oct. 26, 1976

[54] SIGNAL AMPLITUDE MONITOR AND RELAY DRIVER CIRCUIT

[75] Inventor: Sandor Mentler, Philadelphia, Pa.

[73] Assignee: General Electric Company, Philadelphia, Pa.

[22] Filed: Feb. 10, 1975

[21] Appl. No.: 548,848

[52] U.S. Cl. ..... 317/148.5 R; 307/235 N; 317/31; 317/DIG. 5; 340/248 A

[51] Int. Cl.[2] ..... H01H 47/32

[58] Field of Search ..... 317/DIG. 5, 31, 148.5 R, 317/DIG 1, DIG. 8; 307/235 U, 235 K, 130, 235 N, 235 W; 340/248 R, 248 A, 248 B, 248 C

[56] References Cited

UNITED STATES PATENTS

| | | | |
|---|---|---|---|
| 2,816,262 | 12/1957 | Elliott | 317/DIG. 5 |
| 2,959,717 | 11/1960 | Conger | 317/DIG. 5 |
| 2,980,843 | 4/1961 | Conger et al. | 317/DIG. 5 |
| 3,105,175 | 9/1963 | Siliani et al. | 317/148.5 R |

*Primary Examiner*—Harry Moose
*Attorney, Agent, or Firm*—J. Wesley Haubner

[57] ABSTRACT

A signal amplitude monitor and relay driver circuit. The input signal is applied to a plurality of diodes connected in series with a set of normally closed relay contacts and a first resistor. A second resistor is connected in parallel with the series connected diodes through a set of normally open contacts of the relay. A third resistor is connected in parallel with the combination of the first resistor and normally closed contacts. A transistor circuit is connected with its emitter-base circuit responsive to the signal developed across the first resistor. The transistor output drives an amplifier which energizes the relay coil. When the normally closed contacts are closed the input signal must exceed a first predetermined level before the transistor circuit becomes conductive causing the amplifier to energize the relay coil. When the relay operates the first resistor is taken out of the circuit because the normally closed contacts open, and the second resistor is connected in the circuit because the normally open contacts close. Under these conditions the transistor circuit will remain conductive until the input signal falls below a second predetermined level, the second predetermined level being lower than the first predetermined level.

3 Claims, 1 Drawing Figure

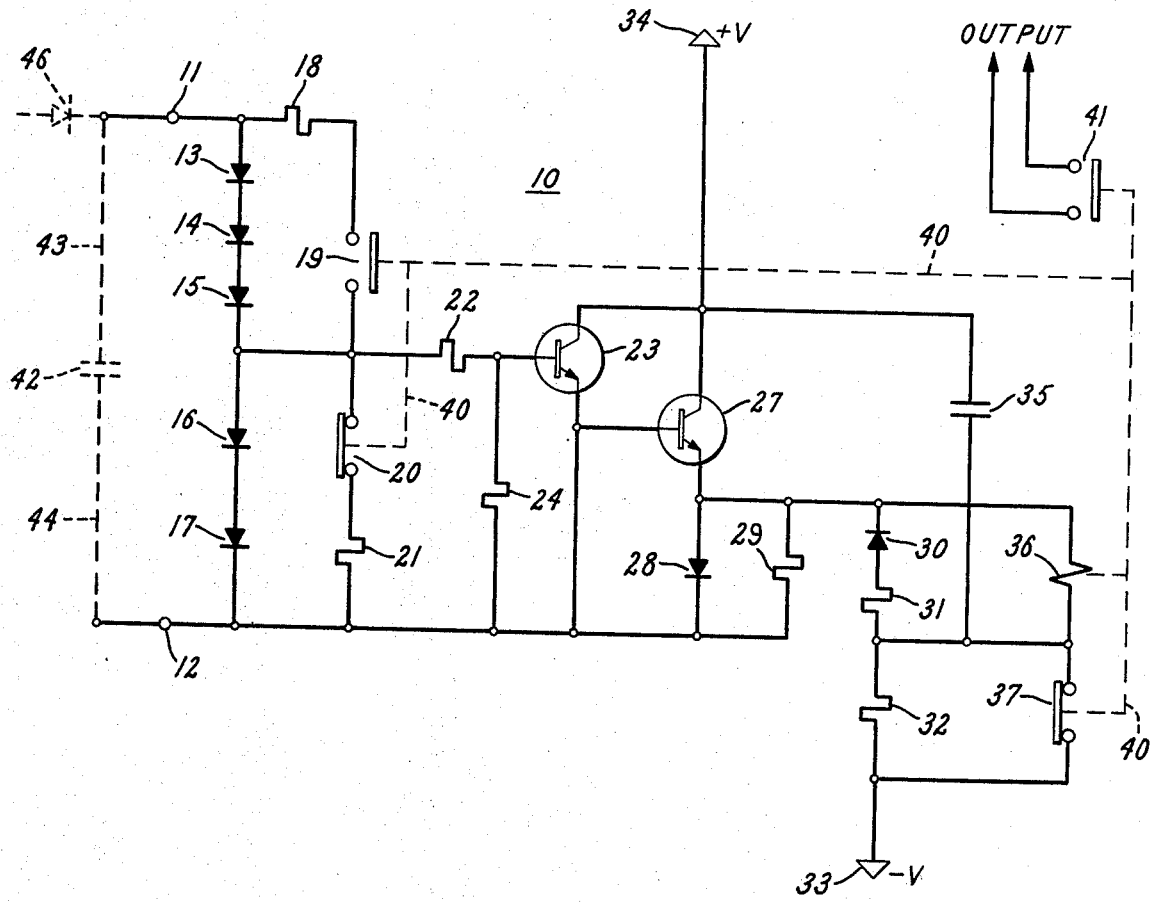
34
+V
OUTPUT
46
11
18
41
13
10
14
43
19
40
15
22
23
42
40
27
35
16
20
24
44
17
21
29
30
36
28
31
12
37
32
40
33
-V

SIGNAL AMPLITUDE MONITOR AND RELAY DRIVER CIRCUIT

BACKGROUND OF THE INVENTION

This invention relates to fault monitoring circuits and in particular to a fault monitoring circuit for picking up a relay in response to the monitored signal exceeding a first predetermined level and dropping out the relay in response to the monitored signal falling below a second predetermined level lower than the first predetermined level.

In one type of monitor and relay driver circuit it is desirable to have the monitor circuit responsive to a first predetermined signal level for picking up the relay, and to have the monitor circuit responsive to a second lower predetermined signal level for dropping out the relay once the relay has been picked up.

A problem arises when a voltage or a current responsive monitor and relay driver circuit is used to determine when the amplitude of a series of recurring pulses exceeds a first predetermined magnitude. If the amplitude of the input pulses falls below the drop out level of the relay, and there is sufficient time between pulses for the relay to actually drop out, the relay contacts will chatter. It is desirable to eliminate this relay chatter.

It is, therefore, one object of this invention to provide a monitor and relay driver circuit that responds to a first predetermined signal level for picking up the relay but responds to a second, lower, predetermined signal level for dropping out the relay after the relay has been picked up.

It is another object of this invention to provide a monitor and relay driver circuit that will not allow the contacts of the relay to chatter when used to monitor the amplitude of a series of recurring pulses.

SUMMARY OF THE INVENTION

In the monitor and relay driver circuit of this invention the input signal is applied to a plurality of diodes connected in series with a set of normally closed relay contacts and a first resistor. A second resistor is connected in parallel with the series connected diodes through a set of normally open contacts of the relay. A third resistor is connected in parallel with the combination of the first resistor and normally closed contacts. A transistor circuit is connected with its emitter-base circuit responsive to the signal developed across the first resistor. The transistor output drives an amplifier which energizes the relay coil. When the normally closed contacts are closed the input signal must exceed a first predetermined level before the transistor circuit becomes conductive causing the amplifier to energize the relay coil. When the relay operates the first resistor is taken out of the circuit because the normally closed contacts open. and the second resistor is connected in the circuit because the normally open contacts close. Under these conditions the transistor circuit will remain conductive until the input signal falls below a second predetermined level, the second predetermined level being lower than the first predetermined level. If the circuit is being used to monitor the amplitude of recurring pulses, the input signal can be applied to a capacitor filter in order to keep the relay coil energized during the interpulse period thereby preventing relay chatter.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying FIGURE which is a schematic diagram of the monitor and driver circuit.

DETAILED DESCRIPTION

Referring now to the FIGURE, there is shown a monitor and relay driver circuit for energizing a relay coil 36 which operates contacts 41. The input signal to the monitor and relay driver circuit 10 is applied to input terminals 11 and 12. If the input signal is a voltage source, as the magnitude of the input voltage increases, diodes 13, 14, and 15 will eventually become conductive allowing current to flow through diodes 13, 14, and 15, which form one leg of a voltage divider network, through normally closed contacts 20, and through resistor 21, which form the other leg of a voltage divider network. When the input voltage at terminal 11 reaches about 2.4 volts, the voltage developed across resistor 21 will be about 0.6 volts and transistor 23, having its base-emitter circuit connected across resistor 24, will be made conductive which allows base current to be provided for transistor 27, thereby making transistor 27 conductive. Similarly, if the input signal is a current source, transistor 27 will beome conductive when the voltage developed across resistor 21 reaches 0.6 volts.

When transistor 27 is conductive the relay coil 36 will be energized from power sources 33 and 34. When the relay coil 36 is energized, it closes contacts 19 and opens contacts 20 as indicated by the dashed line 40. When relay coil 36 operates to open contacts 20 and close contacts 19, the input signal level that will control the conduction of transistors 23 and 27 is determined by the values of resistor 18 and 24 if the input signal is a volage source and by the value of resistor 24 alone if the signal is a current source. The values of resistors 18 and 24 can be selected so that the relay remains energized even though the input signal amplitude decreases substantially after the relay has operated.

When the relay coil 36 is energized the full power supply voltage is applied directly across the coil 36 because contacts 37 are closed. Once the relay has picked up, contacts 37, which are controlled by the relay coil 36 as indicated by dashed lines 40, will open and the current through the relay coil 36 will be limited by resistor 32 to that level of current required to maintain the relay in the energized condition.

If the monitor and relay driver circuit 10 is to be used to monitor the amplitude of a series of recurring pulses, and the interval from the time that it takes a pulse to fall below the predetermined magnitude until the next successive pulse exceeds the predetermined magnitude, is greater than the time it will take for the relay contacts to drop out, the relay contacts will chatter. To eliminate this chattering a capacitor 42 is connected across input terminals 11 and 12 as indicated by dashed lines 43 and 44. As described above, the relay coil 36 will be energized when the voltage on capacitor 42 reaches about 2.4 volts. After relay contacts 19 close and contacts 20 open, the voltage appearing on capacitor 42 will discharge through the circuit formed by resistor 18, closed contacts 19, resistor 22, and the emitter-base circuit of transistor 23. The time constant of this discharge path is chosen so that capacitor 42 will maintain transistor 23 in the conductive state until the succeeding pulse exceeds the predetermined signal level.

Diode 30 and resistor 31 provide a path for the current through relay coil 36 when transistor 27 is made non-conductive. Diodes 16 and 17 serve two functions. First of all, they operate in conjunction with diodes 13, 14, and 15 to limit the voltage that can appear at the input to about 4 volts. Diodes 16 and 17 in conjunction with resistor 22 also limit the maximum current through the base emitter circuit of transistor 23. Diode 28 limits the reverse voltage across the emitter-base junction of transistor 27 during surges while capacitor 35 provides surge protection for the collect-or-emitter circuit of transistor 27.

When the monitor and relay driver circuit 10 is being used to monitor the amplitude of a pulse train generated from a voltage source, it is desirable that the impedance level of the signal source be relatively low when the source is tending to charge capacitor 42 and that the impedance level of the signal source be high when the input signal falls below the voltage on capacitor 42. If the signal source has a low input impedance, the input signal source can be applied to the capacitor through a diode 46, as shown. The use of the capacitor 42 provides some protection against false indications due to short duration surges such as might be caused by noise. The signal applied to the capacitor 42 must be of sufficient amplitude and duration to charge capacitor 42 above the predetermined voltage lvel that will cause transistors 23 and 27 to conduct and to maintain that predetermined level long enough to pull in the relay. Selection of the size of capacitor 42 provides for some control over the duration of the input signal required to initiate the energization of the relay coil 36.

Component values which operate with one embodiment of the fault monitor circuit herein described are as follows:

| | | |
|---|---|---|
| 42 | capacitor | 1.0 microfarad |
| 13–17 | diodes | 1N5061 |
| 18 | resistor | 3300 ohms |
| 21 | resistor | 360 ohms |
| 22 | resistor | 10 ohms |
| 24 | resistor | 4700 ohms |
| 23, 27 | transistor | 2N3439 |
| 28 | diode | 1N5061 |
| 29 | resistor | 300 ohms |
| 30 | diode | 1N5061 |
| 31 | resistor | 1000 ohms |
| 32 | resistor | 750 ohms |
| 35 | capacitor | 0.05 microfarad |

While the present invention has been described with reference to a specific embodiment thereof, it will be obvious to those skilled in the art that various changes and modifications may be made without departing from the invention in its broader aspects.

It is contemplated in the appended claims to cover all variations and modifications of the invention which may come within the true spirit and scope of the invention.

What I claim as new and desired to secure by letters patent of the United States is:

1. A circuit for operating a relay in response to an input signal comprising:

a. a plurality of diodes connected in series with a first resistor and normally closed contacts of the relay, said series combination being driven by the input signal;

b. a second resistor connected in parallel with the series connected diodes through normally open contacts of the relay;

c. a third resistor connected in parallel circuit with the combination of the first resistor and normally closed contacts;

d. a transistor circuit having its emitter-base circuit responsive to the signal developed across the thrid resistor, said series connected diodes being poled to conduct current through said emitter-base circuit, said transistor becoming conductive when the normally closed contacts are closed and the input signal exceeds a first predetermined magnitude, but becoming nonconductive when the normally open contacts are closed and the input signal falls below a second predetermind level, less than the first predetermined level; and e. circuit means responsive to the transistor circuit output for energizing the relay when the transistor is conductive and deenergizing the relay when the transistor is nonconductive.

2. A circuit for operating an electromagnetic relay between picked-up and dropped-out positions which comprises:

a. a pair of signal input terminals, b. a plurality of diodes connected in series circuit relation between said input terminals, said series circuit providing an intermediate terminal defining serially adjacent sections of a voltage divider including said diodes, c. a pair of shunt circuits alternately completed by said relay in its picked-up and dropped-out positions to connect first and second shunting resistors across said voltage divider sections respectively, a first said shunting resistor being of substantially smaller magnitude than the other said shunting resistor and being connected across a first section of said voltage divider when said relay is in said dropped-out position, d. a third resistor connected across said first section of said voltage divider, said third resistor being of substantially greater magnitude than said first shunting resistor, and e. transistor means having an emitter-base circuit connected across said third resistor and an output circuit connected to energize said relay, f. said voltage divider and alternate shunting circuits being operable to initiate transistor output current in response to a first high level of input signal and to maintain said transistor output current over a range of input signal levels between said high level and a second discretely lower level.

3. A circuit as recited in claim 2 wherein the input signal is a plurality of regularly recurring pulses and wherein a capacitor is connected in parallel circuit relation with said voltage divider, said capacitor maintaining said transistor output current for a time sufficient to maintain the relay in the picked-up position as long as the amplitude of the recurring pulses exceeds said second low signal level.

* * * * *